US007305797B2

(12) United States Patent
Chiang

(10) Patent No.: US 7,305,797 B2
(45) Date of Patent: Dec. 11, 2007

(54) DOOR-CLOSING ASSEMBLY OF FRAMELESS GLASS DOOR

(76) Inventor: Fanny Chiang, 12F-1, No. 666, Sec. 2, Wucyuan W. Rd., Nantun District, Taichung City (TW)

( * ) Notice: Subject to any disclaimer, the term of this patent is extended or adjusted under 35 U.S.C. 154(b) by 0 days.

(21) Appl. No.: 11/709,246

(22) Filed: Feb. 22, 2007

(65) Prior Publication Data

US 2007/0228742 A1 Oct. 4, 2007

Related U.S. Application Data

(63) Continuation-in-part of application No. 11/393,746, filed on Mar. 31, 2006.

(51) Int. Cl.
*E05D 7/08* (2006.01)
*E05D 7/12* (2006.01)

(52) U.S. Cl. ..... 49/388; 16/252; 16/255

(58) Field of Classification Search ..... 292/92, 292/DIG. 4, DIG. 15, DIG. 17, DIG. 61; 16/72, 255, 280, 281, 284, 378, 252, 379; 49/236, 237, 239, 388

See application file for complete search history.

(56) References Cited

U.S. PATENT DOCUMENTS 1,122,322 A * 12/1914 Smith ..... 16/292
5,867,869 A * 2/1999 Garrett et al. ..... 16/252
5,867,871 A * 2/1999 Tasman ..... 16/335
6,161,255 A * 12/2000 Garrett ..... 16/284
6,519,811 B1 * 2/2003 Cheng ..... 16/252
6,766,561 B1 * 7/2004 Cheng ..... 16/235
6,966,150 B2 * 11/2005 Chiang ..... 49/388
7,127,777 B2 * 10/2006 Chiang ..... 16/252

* cited by examiner

*Primary Examiner*—Carlos Lugo
(74) *Attorney, Agent, or Firm*—Rabin & Berdo, P.C.

(57) ABSTRACT

A door-closing assembly is used on a frameless glass door and has a body, a drive device, a mounting bracket and a holding device. The body has a mounting panel and a casing. The casing has an outer end, a transverse hole and a longitudinal hole. The longitudinal hole is formed in the outer end of the casing and communicates with the transverse hole. The drive device is mounted in the body and has a stationary post, a drive plug, a threaded plug and a spring. The stationary post is mounted inside the transverse hole. The drive plug is slidably mounted in the longitudinal hole and presses against the stationary post. The threaded plug is screwed in the longitudinal hole. The spring is held between the drive plug and the threaded plug. The mounting bracket is holds the stationary post in place. The holding device is mounted around the body.

11 Claims, 5 Drawing Sheets

DOOR-CLOSING ASSEMBLY OF FRAMELESS GLASS DOOR

The present invention is a continuation-in-part of application Ser. No. 11/393,746 filed on Mar. 31, 2006.

BACKGROUND OF THE INVENTION

1. Field of the Invention

The present invention relates to a door-closing assembly, and more particularly to a door-closing assembly for a frameless glass door that is manufactured and assembled quickly and conveniently.

2. Description of Related Art

In general, a door can be made of glass, wood or metal, and a user must apply a force to keep the door open, then apply a force to close the door return in place, so user needs to open and close the door repeatedly. Furthermore, opening or closing the door is inconvenient especially when the user is holding something in his or her hands.

Therefore, the invention provides a door-closing assembly of a frameless glass door to mitigate or obviate the aforementioned problems.

SUMMARY OF THE INVENTION

The main objective of the present invention is to provide a door-closing assembly of a frameless glass door and that can close a door automatically and is manufactured and assembled quickly and conveniently.

The door-closing assembly is used on a frameless glass door and has a body, a drive device, a mounting bracket and a holding device. The body has a mounting panel and a casing. The casing has an outer end, a transverse hole and a longitudinal hole. The longitudinal hole is formed in the outer end of the casing and communicates with the transverse hole. The drive device is mounted in the body and has a stationary post, a drive plug, a threaded plug and a spring. The stationary post is mounted inside the transverse hole. The drive plug is slidably mounted in the longitudinal hole and presses against the stationary post. The threaded plug is screwed in the longitudinal hole. The spring is held between the drive plug and the threaded plug. The mounting bracket is holds the stationary post in place. The holding device is mounted around the body.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
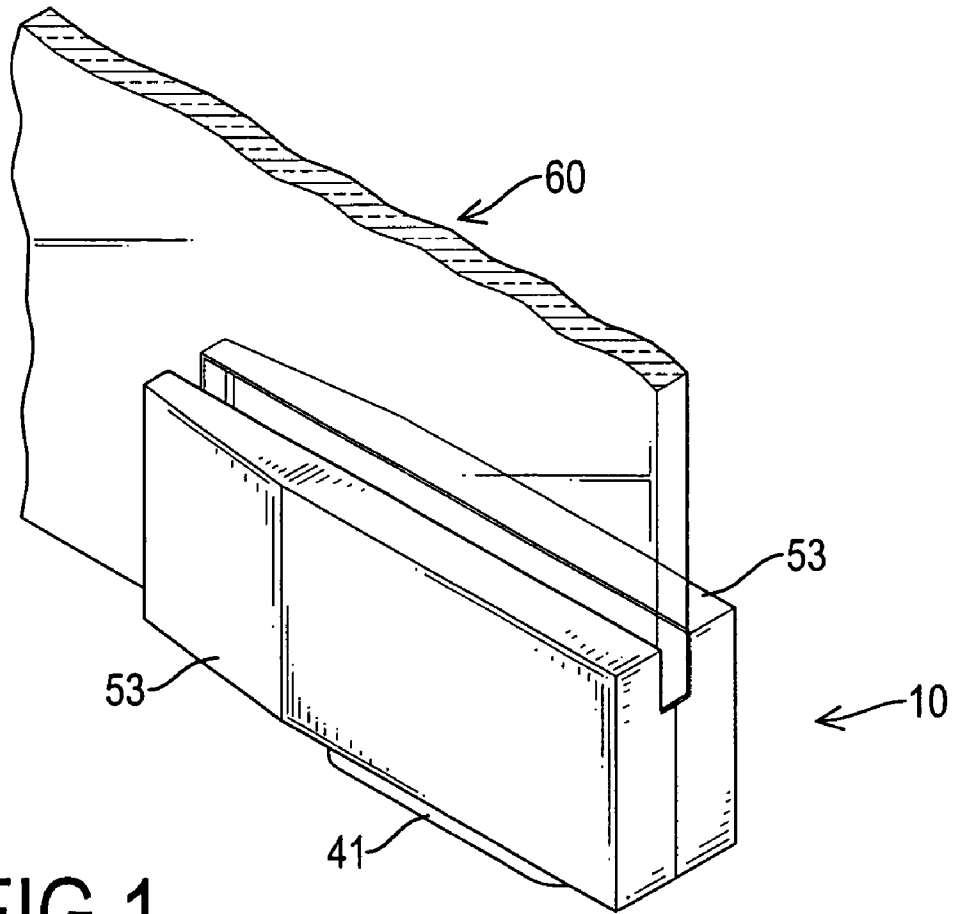
FIG. 1 is a perspective view of a door-closing assembly in accordance with the present invention mounted on a frameless glass door.
Figure 2:
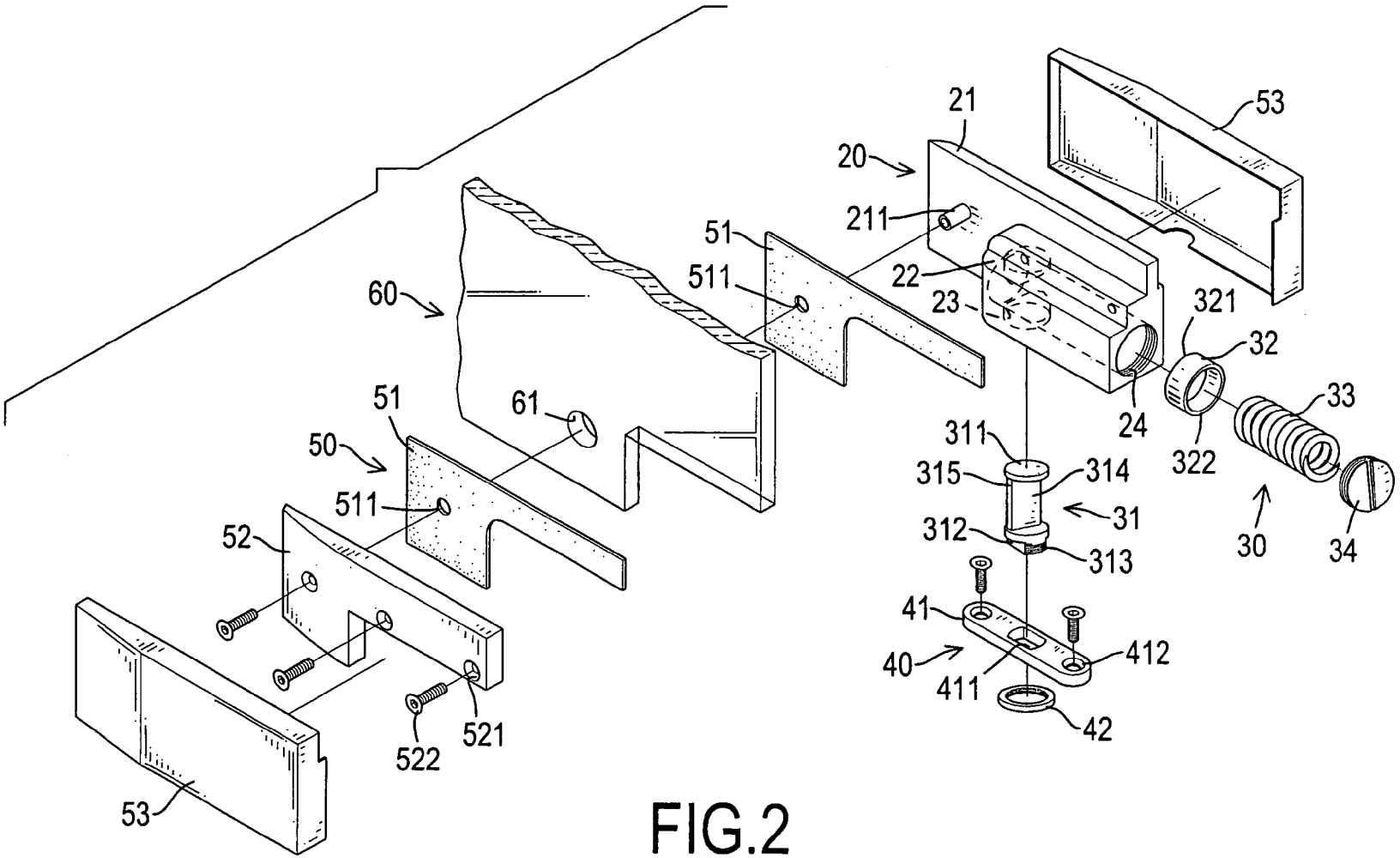
FIG. 2 is an exploded perspective view of the door-closing assembly in FIG. 1.
Figure 3:
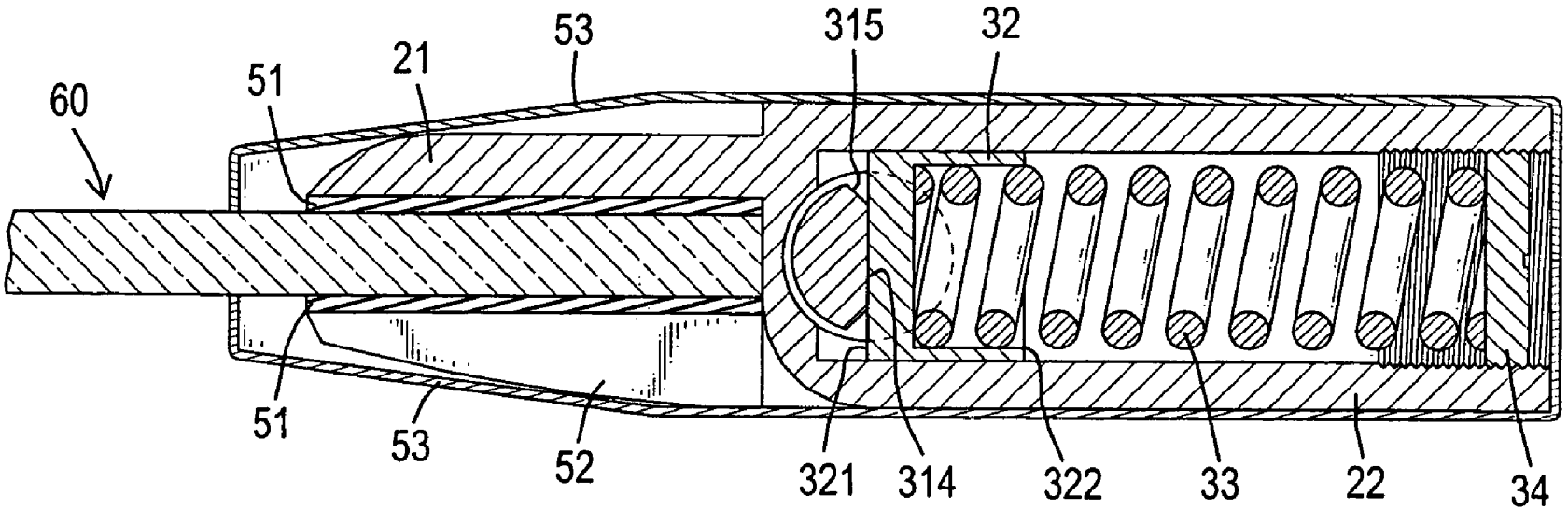
FIG. 3 is a cross sectional top view of the door-closing assembly in FIG. 1.

With reference to FIGS. 1 to 3, a door-closing assembly (10) in accordance with the present invention is used on a frameless glass door (60) having two sides, a bottom and a through hole (61) and comprises a body (20), a drive device (30), a mounting bracket (40) and a holding device (50).

The body (20) is mounted on the bottom of the frameless glass door (60) and has a mounting panel (21) and a casing (22).

The mounting panel (21) may be rectangular and has front end, a rear end, an inner surface and a mounting post (211). The mounting post (211) is formed on and protrudes from the inner surface of the mounting panel (21) near the front end and extends through the through hole (61) in the frameless glass door (60).

The casing (22) is formed on the inner surface of the mounting panel (21) at the rear end and has a bottom, an inner end an outer end, a transverse hole (23) and a longitudinal hole (24). The transverse hole (23) is formed in the bottom of the casing (22) near the inner end. The longitudinal hole (24) is formed in the outer end of the casing (22), communicates with the transverse hole (23) and has an opening and an internal thread. The opening is formed at the outer end of the casing (22). The internal thread is formed in the opening.

The drive device (30) is mounted in the body (20), is connected to an external surface and has a stationary post (31), a drive plug (32), a threaded plug (34) and a spring (33).

The stationary post (31) is cylindrical, serves as a pivot pin for the frameless glass door (60), is mounted rotatably in and protrudes from the transverse hole (23) and has an upper end (311), a lower end, a key (312), a thread (313) and a drive surface (314).

The upper end (311) of the stationary post (31) extends into the transverse hole (23).

The key (312) is formed on and protrudes longitudinally from the lower end of the stationary post (31) and protrudes from the transverse hole (23).

The thread (313) is formed around the lower end of the stationary post (31) and the key (312).

The drive surface (314) is formed longitudinally on the stationary post (31) between the upper end (311) and the lower end and has two longitudinal edges (315). The longitudinal edges (315) are inclined relative to the drive surface (314).

Figure 4:
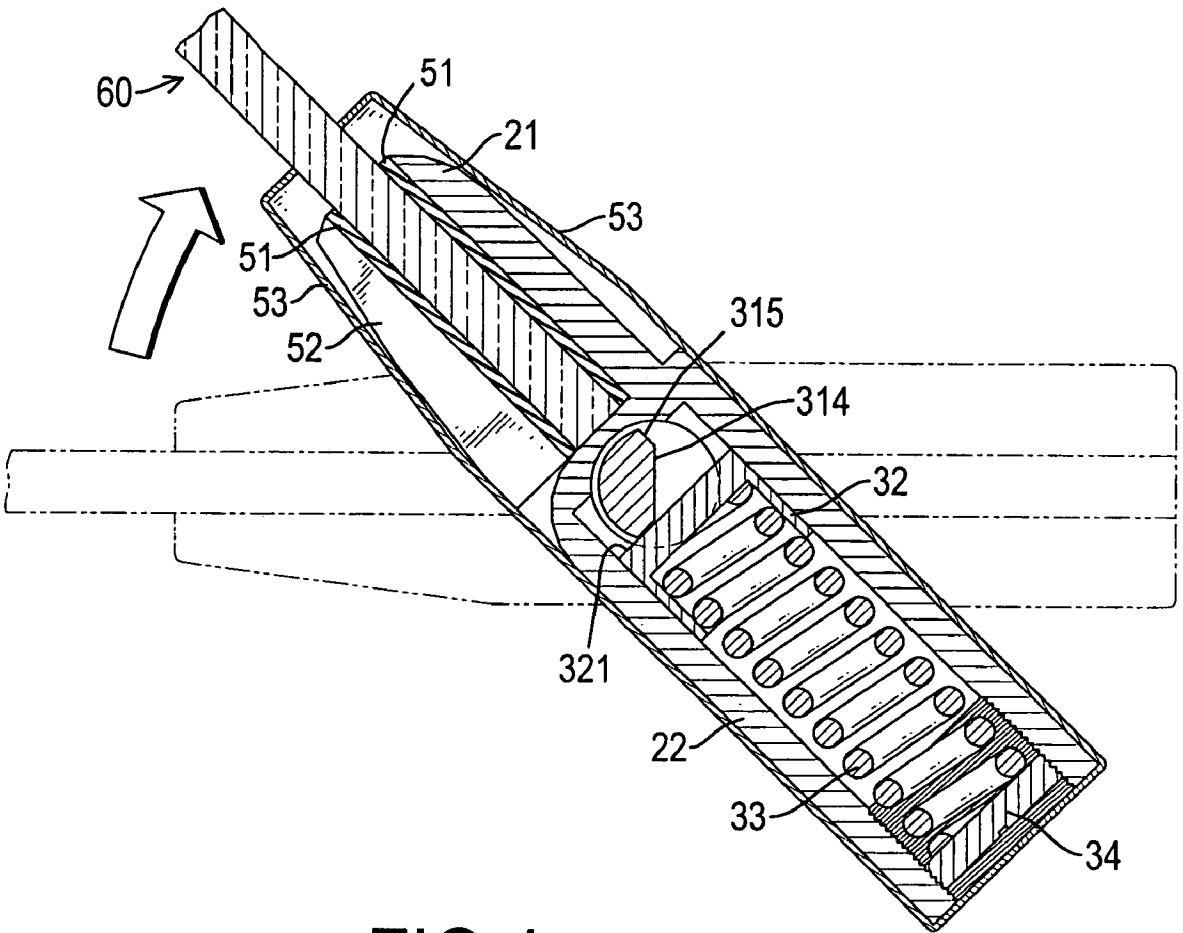
FIG. 4 is an operational cross sectional top view of the door-closing assembly in FIG. 1.
Figure 5:
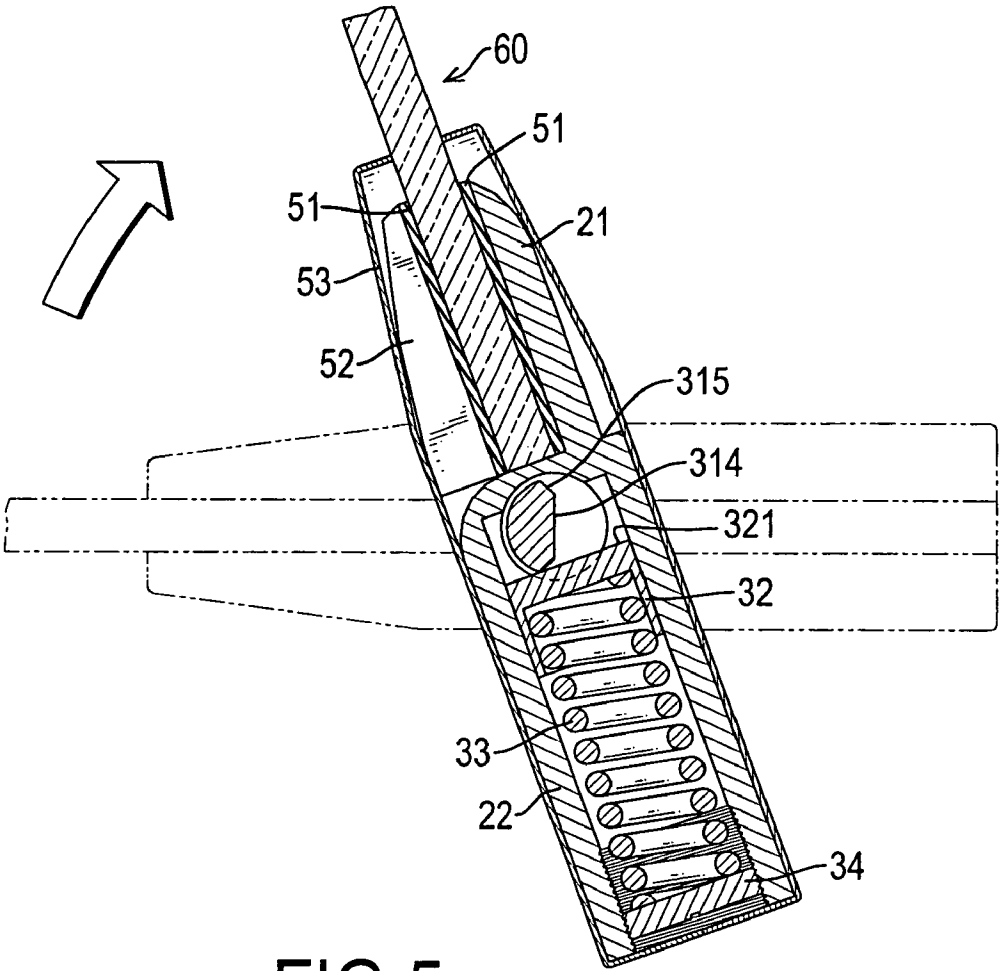
FIG. 5 is another operational cross sectional top view of the door-closing assembly in FIG. 1.

The drive plug (32) is hollow, is mounted slidably in the longitudinal hole (24) in the casing (22) of the body (20), presses the drive surface (314) on the stationary post (31) and may have a closed end (321), an open end (322) and a cavity. With reference to the FIGS. 4 and 5, the closed end (321) selectively presses against the drive surface (314) or one of the returning surfaces (315) to pivot the frameless glass door (60) to a closed position. The open end (322) faces the outer end of the casing (22). The cavity is formed in the drive plug (32) through the open end (322).

The threaded plug (34) screws into the internal thread in opening of the longitudinal hole (24).

The spring (33) is mounted in the longitudinal hole (24) between the cavity in the drive plug (32) and the threaded plug (34) and may be mounted in the cavity in the drive plug (32).

The mounting bracket (40) is connected to an external horizontal surface, holds the stationary post (31) securely in position and has a bracket (41), fasteners and a connector (42). The bracket (41) may be rectangular, is connected to an external horizontal surface, engages and holds the key (312) on the stationary post (31) and has a center, a mounting hole (411) and two circular holes (412).

The mounting hole (411) is formed through the center of the bracket (41), corresponds to the key (312) and engages and holds the key (312) such that the key (312) extends through the mounting hole (411).

The circular holes (412) are formed through the bracket (41) around the mounting hole (411).

The fasteners extend respectively through the circular holes (412), connect securely to the external horizontal surface to fasten the mounting bracket (40) securely to the external horizontal surface and may be bolts, rivets or the like.

The connector (42) connects to the key (312) extending through the mounting hole (411) to hold the stationary post (31) in the mounting hole (411) and may be a threaded ring that screws onto the thread (313) on the key (312).

The holding device (50) is mounted around the body (20), holds the body (20) on the frameless glass door (60) and has two gaskets (51), a clamping panel (52) and two covers (53).

The gaskets (51) are mounted respectively on opposite sides of the frameless glass door (60), and each gasket (51) has a post hole (511). One gasket (51) is mounted between the frameless glass door (60) and the inside surface of the mounting panel (21). The post holes (511) are formed respectively through the gaskets (51) and correspond respectively to and communicate with the through hole (61) in the frameless glass door (60) so the mounting post (211) the mounting panel (21) in the body (20) can extend through the post holes (511) in the gaskets (51) and the through hole (61) in the frameless glass door (60).

With further reference to FIGS. 2 and 3, the clamping panel (52) is connected to the mounting panel (21) and the casing (22), squeezes one of the gaskets (51) and has multiple connecting holes (521) and multiple fasteners (522). One of the connecting holes (521) communicates with the post holes (511) in the gaskets (51) and the through hole (61) in the frameless glass door (60). The fasteners (522) attach the mounting panel (21) to the clamping panel (52), securely clamp the frameless glass door (60) between the mounting panel (21) and the clamping panel (52) and may be bolts or screws. One of the fasteners (522) connects to the mounting post (211) of the mounting panel (21), and the other fasteners connect to the casing (22).

The covers (53) are symmetrical, are attached to each other and respectively to the mounting panel (21) and the clamping panel (52) and cover the mounting panel (21), the clamping panel (52) and the casing (22).

The door-closing assembly (10) of a frameless glass door in accordance with the present invention has the following advantages:

1. The door-closing assembly (10) can close the frameless glass door (60) automatically by the spring (32) pushing the closed end (321) of the drive plug (32) against the drive surface (314). Therefore, closing the door is convenient even when hands of a user are not free.

2. Installing the door-closing assembly (10) on a frameless glass door (60) is easy, and the door-closing assembly (10) is convenient to manufacture.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A door-closing assembly on a frameless glass door that is capable of being open in two opposite direction and having two sides, and the door-closing assembly comprising:

a body having
- a mounting panel having
  - a front end;
  - a rear end;
  - an inner surface; and
  - a mounting post; and
- a casing formed on the inner surface of the mounting panel at the rear end and having
  - a bottom;
  - an inner end;
  - an outer end;
  - a transverse hole being formed in the bottom of the casing near the inner end; and
  - a longitudinal hole being formed in the outer end of the casing, communicating with the transverse hole and having
    - an opening formed at the outer end of the casing; and
    - an internal thread being formed in the opening;

a drive device being mounted in the body, being connected to an external surface and having
- a stationary post being cylindrical to serve as a pivot pin for the frameless glass door, being mounted rotatably in the transverse hole and having
  - an upper end extending into the transverse hole;
  - a lower end;
  - a key being formed on and protruding longitudinally from the lower end of the stationary post and protruding from the transverse hole; and
  - a drive surface being formed longitudinally on the stationary post between the upper end and the lower end having two planar returning longitudinal edges inclined relative to the drive surface;
- a drive plug being hollow, being mounted slidably in the longitudinal hole in casing of the body and pressing the drive surface on the stationary post;
- a threaded plug screwing into the internal thread in the opening of the longitudinal hole; and
- a spring being mounted in the longitudinal hole between the drive plug and the threaded plug; and a mounting bracket being connected to an external horizontal surface, holding the stationary post securely in position and having a bracket being connected to an external horizontal surface, engaging and holding the key on the stationary post and having
- a center; and
- a mounting hole formed through the center of the bracket, corresponding to the key and engaging and holding the key that extends into the mounting hole; and a holding device being mounted around the body to hold the body on the frameless glass door and having
- a clamping panel being connected to the mounting panel and the casing and having
  - multiple connecting holes; and
  - multiple fasteners attaching the mounting panel to the clamping panel to securely clamp the frameless glass door between the mounting panel and the clamping panel.

2. The door-closing assembly as claimed in claim 1, wherein the holding device further has two gaskets adapted to be mounted respectively on opposite sides of the frameless glass door, and each gasket has a post hole; and two covers being symmetrical, being attached to each other and respectively to the mounting panel and the clamping panel and covering the mounting panel, the clamping panel and the casing.

3. The door-closing assembly as claimed in claim 2, wherein the drive plug has a closed end selectively pressing against the drive surface and the returning surfaces;

an open end facing the outer end of the casing; and a cavity formed in the drive plug through the open end; and the spring is mounted in the cavity.

4. The door-closing assembly as claimed in claim 3, wherein the bracket is rectangular and further has two circular holes formed through the bracket around the mounting hole; and the mounting bracket further has multiple fasteners extending respectively through the circular holes and connecting securely to the external horizontal surface to fasten the mounting bracket securely to the external horizontal surface.

5. The door-closing assembly as claimed in claim 4, wherein the mounting bracket further has a connector connecting to the key extending through the mounting hole to hold the stationary post in the mounting hole.

6. The door-closing assembly as claimed in claim 5, wherein the stationary post further has a thread formed around the lower end of the stationary post and the key; and the connector of mounting bracket is a threaded ring screwing onto the thread on the key.

7. The door-closing assembly as claimed in claim 6, wherein the mounting post being formed on and protruding from the inner surface of the mounting panel near the front end; and one of the fasteners being connected to the mounting post of the mounting panel and the other fasteners being connected to the casing.

8. The door-closing assembly as claimed in claim 1, wherein the drive plug has a closed end selectively pressing against the drive surface and the returning surfaces;

an open end facing the outer end of the casing; and a cavity formed in the drive plug through the open end; and the spring is mounted inside the cavity.

9. The door-closing assembly as claimed in claim 1, wherein the bracket is rectangular and further has multiple circular holes formed through the bracket around the mounting hole; and the mounting bracket further has multiple fasteners extending respectively through the circular holes and connecting securely to the external horizontal surface to fasten the mounting bracket securely to the external horizontal surface.

10. The door-closing assembly as claimed in claim 1, wherein the stationary post further has a thread formed around the lower end of the stationary post and the key; and the connector of mounting bracket is a threaded ring screwing onto the thread on the key.

11. The door-closing assembly as claimed in claim 1, wherein the mounting post being formed on and protruding from the inner surface of the mounting panel near the front end; and one of the fasteners being connected to the mounting post of the mounting panel and the other fasteners being connected to the casing.

* * * * *